US008072132B2

(12) United States Patent
Böröczki et al.

(10) Patent No.: US 8,072,132 B2
(45) Date of Patent: Dec. 6, 2011

(54) DISCHARGE VESSEL AND HIGH INTENSITY DISCHARGE LAMP HAVING SUCH DISCHARGE VESSEL

(75) Inventors: Ágoston Böröczki, Budapest (HU); Attila Agod, Berettyóújfalu (HU)

(73) Assignee: General Electric Company, Schenectady, NY (US)

( * ) Notice: Subject to any disclaimer, the term of this patent is extended or adjusted under 35 U.S.C. 154(b) by 79 days.

(21) Appl. No.: 12/690,580

(22) Filed: Jan. 20, 2010

(65) Prior Publication Data

US 2011/0175526 A1 Jul. 21, 2011

(51) Int. Cl.
*H01J 17/54* (2006.01)

(52) U.S. Cl. ..... 313/493; 313/634

(58) Field of Classification Search ..... 313/493, 313/634

See application file for complete search history.

(56) References Cited

U.S. PATENT DOCUMENTS 4,952,187 A * 8/1990 Ake ..... 445/22
6,015,031 A * 1/2000 Dorfschmid et al. ..... 192/3.58
7,034,461 B2 * 4/2006 Brock ..... 313/634
2006/0255742 A1 11/2006 Haacke et al.

* cited by examiner

*Primary Examiner* — Vip Patel
(74) *Attorney, Agent, or Firm* — Fay Sharpe LLP

(57) ABSTRACT

A discharge vessel for high intensity discharge lamps is disclosed. The discharge vessel comprises an elongated arc chamber having a longitudinal axis of rotational symmetry. It has a translucent wall made of fused silica glass, or alternatively ceramic material. A pair of electrodes is located at opposite ends of the arc chamber for providing discharge arc. The wall of the arc chamber has at least one inwardly protruding circumferential narrowed portion thereby the arc chamber is divided into convection cells.

22 Claims, 3 Drawing Sheets

DISCHARGE VESSEL AND HIGH INTENSITY DISCHARGE LAMP HAVING SUCH DISCHARGE VESSEL

BACKGROUND OF THE INVENTION

This invention relates to discharge vessels and high intensity discharge lamps having such discharge vessel.

Usually, the arc chamber in a discharge vessel of a high intensity discharge (HID) lamp has ellipsoidal or cylindrical shape, and sometimes the end part of the arc chamber is also shaped, e.g. to have a hemispherical or conical geometry to either reduce end losses, or optimize arc chamber thermals. In a horizontally operated HID arc chamber, the convection gas flow that is induced by the buoyancy force acting upon a hot gas volume surrounded by a cooler gas environment makes the arc to bend upwards. This is, because a convection cell is developing in the arc chamber. The fill gas convection in the central part of the convection cell pushes the hot gas to reach the upper wall subsequently the hot gas turns towards the two end parts of the chamber. On the other hand, the cooler gas arriving from the end parts of the arc chamber and flowing at the bottom of the chamber turns to move upwards in the central section of the convection cell. The gas convection in this way modifies the temperature distribution of the plasma to become non rotational symmetric in the arc chamber. As a result, this leads to arc bending upwards, and consequently the arc shape is distorted from a straight line into an upward curved line.

One can conclude then, that the conventional geometry options of the HID arc chambers do not fully control the shape of the arc, namely the degree of arc bending when the lamps are burning in horizontal orientation. The conventional arc chambers by their relatively large dimensions act as a single convection cell that allow gas velocities to be extremely intense, and lead to the above described phenomenon of arc bending.

There have been some attempts so far to make the arc straighter. Some of the current HID lamps, among others discharge automotive lamps, still use "constant wall thickness" geometry, that is an ellipsoidal discharge vessel and an ellipsoidal inner arc chamber geometry, but the leading lamps in the market have discharge vessels of a more complex shape. The most common shape is an ellipsoidal outer geometry, and a cylindrical central portion plus conical end portions inside. The aim of the central cylindrical portion is to make the arc "wall stabilized" that is to "push" the bowed arc towards the longitudinal axis of the arc chamber.

Additionally, proposals for making the shape of the inner arc chamber partly convex can also be found in the patent literature. Either the bottom or the top center portion of the inside geometry is made to be convex in these proposals. In addition to the noble gas fill, arc chambers of HID lamps generally also contain other ionizable fill materials that are in liquid phase when the lamp is in operation. At metal halide lamps, this liquid gas phase constitutes a halide pool located at the coldest portion of the arc chamber. The liquid phase is in equilibrium with its vapor. When the inner surface is convex at the bottom, the aim is to raise the position of the liquid halide pool so that it becomes closer to the arc, and the vapor pressure of the halide dose is increased due to the increased dose pool temperature by more effective radiation heating from the arc. In this respect, U.S. Pat. No. 7,348,731, for example, discloses a high-pressure gas discharge lamp with an asymmetrical discharge space (arc chamber) and/or an asymmetrical discharge vessel. The arc chamber (discharge space) has a volume, which is reduced by a given first factor in comparison with the volume of the arc chamber of known mercury-containing discharge lamps. The quantity of the light-generating substances in the arc chamber (discharge space) is reduced by the same factor in the simplest case, or even more strongly in less simple cases. This avoids the risk of an impairment of the imaging properties of the lamp due to non-evaporated light-generating substances, which may shade off a portion of the luminous discharge arc and/or the tips of the electrodes.

The problem of the present invention is however different, namely to make the arc of a horizontally operated HID lamp straighter. The straightness of the arc between the opposing electrodes has great advantage in high efficiency optical systems, since imaging of a straight arc is more efficient than that of a distorted or bent one. More importantly, the straightness of the arc is a need in automotive headlamps where strict requirements exist with respect to the maximum and minimum illumination levels on the road or the test screen. The straighter the arc, the easier to meet these requirements.

Accordingly, there is a need for a HID lamp with an improved discharge vessel configuration, which provides better discharge arc orientation within the arc chamber in horizontal operational position. There is also a need for an improved discharge vessel structure, which ensures that the light distribution of the lamp, such as an automotive HID lamp, will be more homogenous in the illumination space. It is sought to provide a solution, which, besides having an improved discharge arc orientation, applicable to discharge vessels of either fused silica glass or ceramic material.

SUMMARY OF THE INVENTION

In an exemplary embodiment of the present invention, there is provided a discharge vessel for high intensity discharge lamps comprising an elongated arc chamber having a longitudinal axis of rotational symmetry. A translucent wall of the discharge vessel is made of fused silica glass. A pair of electrodes is located in opposite ends of the arc chamber for providing discharge arc. The wall of the arc chamber has at least one inwardly protruding circumferential narrowed portion thereby the arc chamber is divided into convection cells.

In an exemplary embodiment of another aspect of the invention, there is provided discharge vessel for high intensity discharge lamps comprising an elongated arc chamber with a longitudinal axis of rotational symmetry. A wall of the discharge vessel is made of a ceramic material. A pair of electrodes is located in opposite ends of the arc chamber for providing discharge arc. The wall of the arc chamber has at least one inwardly protruding circumferential narrowed portion thereby the arc chamber is divided into convection cells.

In an exemplary embodiment of a further aspect of the invention, there is provided a high intensity discharge lamp, which has a discharge vessel comprising an elongated arc chamber, in which the wall of the arc chamber has at least one inwardly protruding circumferential narrowed portion, thereby the arc chamber is divided into convection cells.

The disclosed discharge vessel structure and HID lamps with this discharge vessel have several advantages over the prior art. The structure ensures that the arc chamber volume is divided into a plurality of smaller sub-chambers, which constitute substantially separated convection cells. The convection cells generate convection currents that have a strength much smaller than the sole convection current in the central portion of the arc chamber of prior art lamps. Therefore, the overall discharge arc bending will be decreased, the arc will be straighter, and the illumination space will be less dependent on the built-in position of the HID lamp. A further advantage over the prior art is that the visible thickness of the discharge arc will be more uniform due to the optical effect of the inwardly protruding circumferential narrowed portions. These circumferential narrowed portions make the arc locally thinner otherwise, but the visible arc may be substantially uniform due to the lens effect of the circumferential narrowed portions.

BRIEF DESCRIPTION OF THE DRAWINGS

The invention will now be described with reference to enclosed drawings, where.

DETAILED DESCRIPTION OF THE INVENTION

Figure 1:
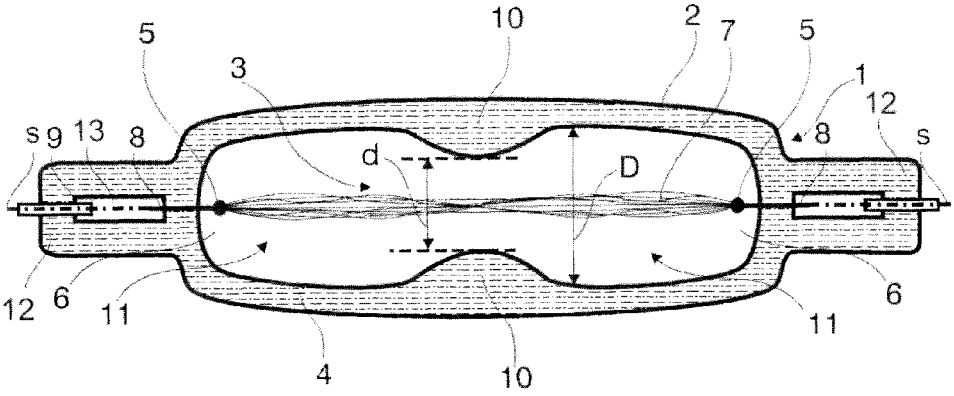
FIG. 1 is a longitudinal cross section of a discharge vessel made of fused silica glass and provided with a narrowed portion for a HID lamp.

Referring now to FIG. 1, there is shown a longitudinal cross section of a discharge vessel for use in a high intensity discharge lamp. The discharge vessel 1 comprises an arc chamber 3 and a pair of electrode shanks 8 with electrode tips 5. Current from an associated power supply (not shown) is fed into the discharge vessel through lead-in wires 9 and corresponding connecting molybdenum foils 13 at flattened seal portions 12 of the discharge vessel 1. The arc chamber 3 is elongated and has a longitudinal axis s of rotational symmetry. A translucent wall 4 of the discharge vessel 1 is made of fused silica glass, and the pair of electrode shanks 8 is located at opposite ends 6 of the arc chamber 3. The associated power supply generates discharge arc 7 between the electrode tips 5. The discharge vessel 1 is filled with an ionizable fill material, which is a source of a discharge gas in operational state of the lamp.

In a first exemplary embodiment of the present invention, the arc chamber 3 has been divided into two sub-chambers in order to decrease convection currents in the discharge gas inside the arc chamber 3. These convection currents generally exert a force of bending on the discharge arc in a transverse direction. The sub-chambers constitute convection cells 11 separated by a circumferential narrowed portion 10, which protrudes substantially transversally to the longitudinal axis s and has a narrowed inside diameter d in the arc chamber 3. The narrowed inside diameter d is reduced to at least 60% of the largest inside diameter D of the discharge vessel 1. The narrowed inside diameter d may preferably be reduced to at least 50%, or more preferably 40% of the largest inside diameter D of the discharge vessel 1. The convection currents in the convection cells 11 created in the arc chamber 3 have smaller strength and exert a smaller force of bending on the discharge arc 7 than the convection currents do in an arc chamber without the circumferential narrowed portion 10.

Figure 2:
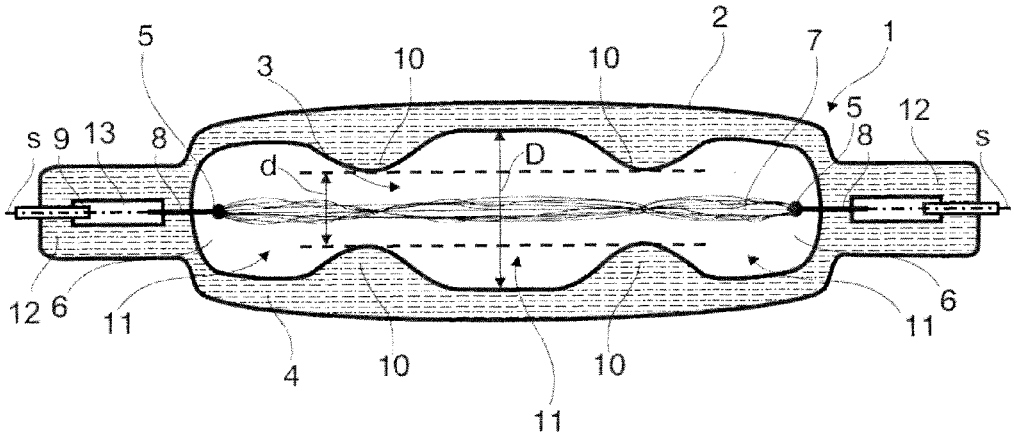
FIG. 2 is a longitudinal cross section of a discharge vessel made of fused silica glass and provided with two narrowed portions for a HID lamp.

As shown in FIGS. 1 and 2, the shape of the outer surface 2 of the discharge vessel 1 is substantially smoothly rounded similarly to the shape of commonly used fused silica discharge vessels. The circumferential narrowed portion 10 of the arc chamber 3 is realized by locally enlarged thickness of the wall 4 of the discharge vessel 1.

FIG. 2 illustrates a further exemplary embodiment of the discharge vessel 1 in longitudinal cross section. From this, it is apparent that the arc chamber 3 may be divided into more than two sub-chambers in order to decrease the strength of convection currents even further inside the arc chamber 3. Increasing the number of the sub-chambers results in smaller convection cells 11, which in turn exerts a smaller force of bending on the discharge arc 7. The greater the number of the convection cells 11, the less is the magnitude of bending of the discharge arc 7. FIG. 2 shows a case when the number of convection cells 11 is three. In addition to the straightening effect on the arc, the circumferential narrowed portions 10 also make the arc 7 thinner locally. The circumferential narrowed portions 10 are realized in the same manner as seen in connection with FIG. 1.

Figure 3:
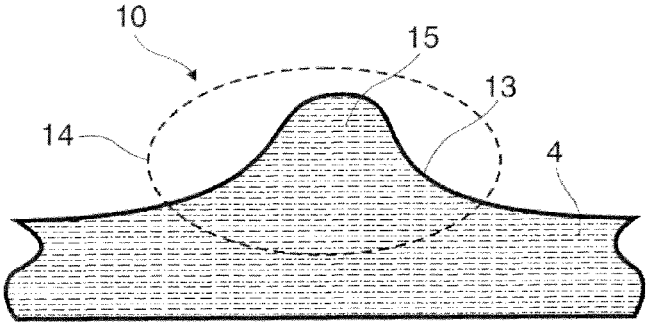
FIG. 3 is an enlarged cross section of the lower side of a narrowed portion shown in FIG. 1 and FIG. 2.

FIG. 3 shows an enlarged cross section of the lower side of the circumferential narrowed portion 10 illustrated in FIG. 1 and FIG. 2. A circular toroidal portion 15 inwardly protruding from the wall 4 is of a rounded shape, and merges with the inner surface of the arc chamber 3 in the direction of the longitudinal axis 9. This toroidal portion 15 constitutes a pseudo lens 14, which provides optical means for compensation of the effect of the locally thinner discharge arc 7 at the circumferential narrowed portions 10. More precisely, the wall 4 and the toroidal portion 15 together constitute the optical lens due to different limiting curvatures. The optical lens gives a magnified image of the portion of the discharge arc located inside the narrowed portion. As a result of this optical magnifying effect, the "visible" thickness of the arc can be kept substantially constant along its entire length.

The evenness of the "visible" thickness of the arc is important in certain applications, such as, for example, automotive headlight lamp applications. In the event of an even arc, the strict conditions for spatial distribution and intensity of illumination can be fulfilled readily.

Figure 4:
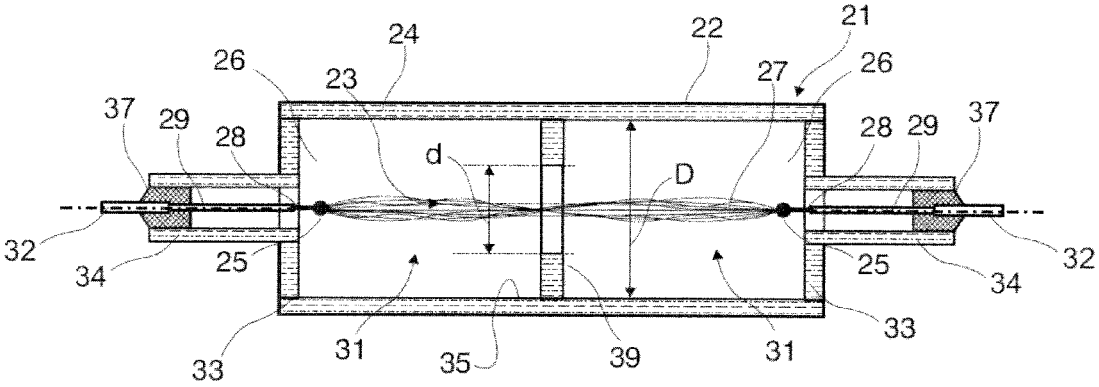
FIG. 4 is a longitudinal cross section of a cylindrical discharge vessel made of ceramic material and provided with a narrowed portion for a HID lamp.

FIG. 4 is a longitudinal cross sectional view of a cylindrical discharge vessel 21 made of ceramic material for a high intensity discharge lamp. Similarly to the arc chamber structure of FIG. 1, the discharge vessel 21 comprises an elongated arc chamber 23 and a pair of electrode shanks 28 with tips 25 and electric connection lead-in wires 32, which are connected to the electrode shank 28 through an electrode portion 29 made of a halide resistant metal, for example molybdenum. A ceramic leg 34 of the lamp encapsulates the halide resistant metal electrode portion 29. The ceramic leg 34 is a tubular piece made of the same material as the discharge vessel 21 and sintered together with that. The end of the ceramic leg 34 remote from the arc chamber is sealed by a sealing material 37, which supports the lead-in wires 32 and the halide resistant metal electrode portion 29 at the same time. The ends of the discharge vessel 21 are closed by ring-shaped ceramic terminating discs 33 sintered to an inner surface portion 35 of the wall 24 of the discharge vessel 31 and the ceramic legs 34. The elongated arc chamber 23 has a longitudinal axis s of rotational symmetry. The discharge vessel 21 has a translucent ceramic wall 24. The electrodes are located in opposite ends 26 of the arc chamber 23, and provide the necessary discharge arc 27 if an associated outer power supply is connected to them. The discharge vessel 21 encloses a discharge volume, which is filled with discharge gas. The discharge vessel 21 has a substantially tubular inner volume and a substantially cylindrical outer surface 22, but discharge vessels with other suitable cross sections may be prepared as well. A better-rounded shape of the outer surface 22 is also possible. This embodiment is provided with the narrowed portion 30 in the middle of the longitudinal axis s of the arc chamber 23.

The narrowed portion 30 is realized in the form of a circular ring 39 built inside the arc chamber 23. The circular ring 39 can also be made of ceramic material, and sintered to the tubular inner surface of the discharge vessel 21. The ceramic terminating discs 33 may be similar pieces.

Figure 5:
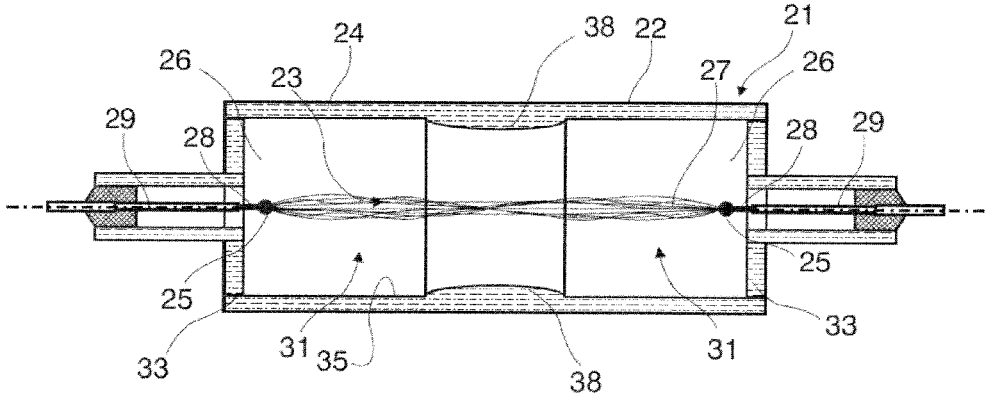
FIG. 5 is a cross section of a cylindrical discharge vessel with a toroidal narrowed portion.

FIG. 5 illustrates an exemplary embodiment, in which a toroidal portion 38 replaces the circular ring 39. The wall 24 of the discharge vessel 21 is made of a transparent ceramic material, for example YAG, and the toroidal portion 38 is an integral part of the wall 24. The toroidal portion 38 has a curved inner surface, which together with the cylindrical wall of the discharge vessel 21 constitutes a pseudo lens similarly to the embodiment explained in connection with FIG. 3 previously.

As it is shown in FIG. 4, the arc chamber 23 now has also been divided into two sub-chambers in order to decrease convection inside the arc chamber 23. The sub-chambers constitute convection cells 31 separated by the inwardly protruding circumferential narrowed portion 30, i.e. the ring 39, which is made as a non-integral part of the wall 24 originally. The ring is mounted as a separate element into the arc chamber 31 and a usual heating treatment of the ceramic results that it fuses to the wall 24 of the discharge vessel 21.

In one embodiment, the narrowed inside diameter d is at least 60% of the largest inside diameter D discharge vessel 21. Preferably, said narrowed inside diameter d can be at least 50% or more preferably 40% of the largest inside diameter D. Thereby the arc chamber 23 becomes effectively divided into local convection cells 31.

Figure 6:
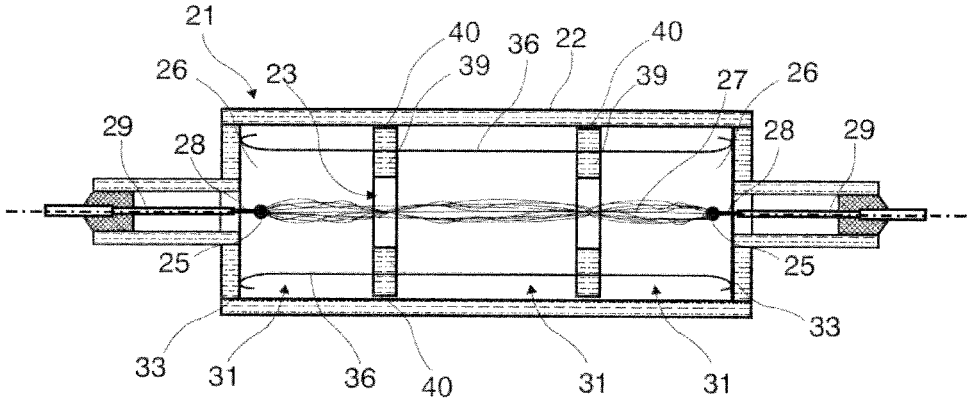
FIG. 6 is a longitudinal cross section of a further cylindrical discharge vessel made of ceramic material and provided with two narrowed portions for a HID lamp.

FIG. 6 shows a further cylindrical discharge vessel structure made of ceramic material. In this case, two rings 39 are applied to the discharge vessel 21 and thus the number of convection cells 31 is three. The circular rings 39, as means for providing narrowed portions 30, are kept in place in the direction of the longitudinal axis and separated from each other and also from the ceramic terminating discs 33 by metallic spacers 36. These spacers 36 can be formed of tungsten wire preferably, and they can be mounted inside the discharge vessel 31 before sintering of the ceramic material thereof. The spacers are sintered into the circular rings 39, and the rings 39 are separated from the discharge vessel 21 by small gaps 40.

Figure 7:
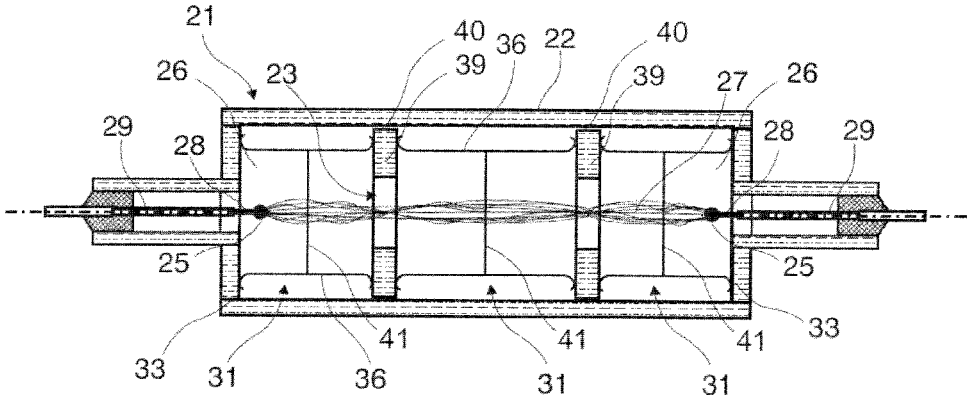
FIG. 7 is a longitudinal cross section of the discharge vessel of FIG. 6, in which segmented metallic spacers are used.

In FIG. 7, a ceramic discharge vessel can be seen, in which segmented metallic spacers 36 are used. The spacers 36 keep the structure components separated during assembling and sintering the discharge vessel, as well as in the operation thereof. The spacers are not sintered into the circular rings 39 in this embodiment, while the rings 39 are separated from the discharge vessel 21 by small gaps 40. The spacers 36 can preferably be formed of tungsten wire segments, which can be connected to each other within the same convection cell 31 by tungsten wire rings 41.

More than two rings 39 can alternatively be used, and the number of the convective cells 31 will be more than three in this way. Any other mechanical means for clamping the rings 39 together is also possible. For example spiral or helically formed tungsten wire spacers can be used.

The invention is not limited to the shown and disclosed embodiments, and other elements, improvements and variations are also within the scope of the invention. For example, it is clear for those skilled in the art that a number of other forms of the discharge vessel, e.g. a discharge vessel with bulbous outer surface may be applicable for the purposes of a high intensity discharge lamp.

The invention claimed is:

1. A discharge vessel for high intensity discharge lamps, the discharge vessel comprising an elongated arc chamber having a longitudinal axis of rotational symmetry, a translucent wall being made of either fused silica glass or a ceramic, a pair of electrodes being located at opposite ends of the arc chamber for providing a discharge arc, and the wall of the arc chamber having at least one inwardly protruding circumferential narrowed portion with a narrowed inside diameter extending inwardly a sufficient extent to impact on convection currents in the arc chamber and straighten the arc discharge, thereby the arc chamber being divided into convection cells.

2. The discharge vessel of claim 1, in which the number of the convection cells is two.

3. The discharge vessel of claim 1, in which the number of the convection cells is at least three.

4. The discharge vessel of claim 1, in which the inwardly protruding circumferential narrowed portion has a circular toroidal shape and constitutes an integral portion of the wall.

5. The discharge vessel of claim 4, in which the circular toroidal portion is smoothly rounded in the direction of the longitudinal axis of the arc chamber.

6. The discharge vessel of claim 1, in which the wall and the inwardly protruding narrowed portion of the wall are formed to constitute together an optical lens for providing a magnified image of the portion of the discharge arc located inside the narrowed portion of the arc chamber.

7. The discharge vessel of claim 1, in which the inwardly protruding narrowed portion has a narrowed inside diameter of approximately 40% to approximately 60% of a largest inside diameter of the discharge vessel.

8. A discharge vessel for high intensity discharge lamps comprising an elongated arc chamber having a longitudinal axis of rotational symmetry, a wall being made either of ceramic material or fused silica glass, a pair of electrodes being located at opposite ends of the arc chamber for providing a discharge arc, and the wall of the arc chamber having at least one inwardly protruding circumferential narrowed portion forming an optical lens for providing a magnified image of the portion of the discharge arc located inside the narrowed portion of the arc chamber, thereby the arc chamber being divided into convection cells.

9. The discharge vessel of claim 8, in which the number of the convection cells is two.

10. The discharge vessel of claim 8, in which the number of the convection cells is at least three.

11. The discharge vessel of claim 8, which has a cylindrical shape.

12. The discharge vessel of claim 11, in which the opposite ends of the discharge vessel are closed by ceramic terminating discs.

13. The discharge vessel of claim 12, in which the at least one inwardly protruding circumferential narrowed portion is formed by a circular ring.

14. The discharge vessel of claim 13, in which the circular rings are separated from each other and the ceramic terminating discs by metallic spacers.

15. The discharge vessel of claim 8, in which the wall is made of a transparent ceramic material.

16. The discharge vessel of claim 15, in which the inwardly protruding circumferential narrowed portion has a circular toroidal shape and is an integral portion of the wall.

17. The discharge vessel of claim 16, in which the wall and the inwardly protruding narrowed portion of the wall are formed to constitute together an optical lens for providing a magnified image of the portion of the discharge arc located inside the narrowed portion of the arc chamber.

18. The discharge vessel of claim 8, in which the inwardly protruding narrowed portion has a narrowed inside diameter of approximately 40% to approximately 60% of the largest inside diameter of the discharge vessel.

19. A high intensity discharge lamp having a discharge vessel comprising an elongated arc chamber having a wall, the wall of the arc chamber having at least one inwardly protruding circumferential narrowed portion with a narrowed inside diameter of approximately 40% to approximately 60% of a largest inside diameter of the discharge vessel, thereby the arc chamber being divided into local convection cells.

20. The discharge vessel of claim 19, in which the at least one inwardly protruding circumferential narrowed portion is formed by a circular ring.

21. The discharge vessel of claim 20, in which the circular rings are separated from each other and the ceramic terminating discs by metallic spacers.

22. The discharge vessel of claim 21 wherein the ring is separated from the discharge vessel by a gap.

* * * * *